US008199957B2

(12) United States Patent
Ohguchi et al.

(10) Patent No.: US 8,199,957 B2
(45) Date of Patent: Jun. 12, 2012

(54) SPEAKER UNIT AND AUDIO OUTPUT ROBOT DEVICE

(75) Inventors: Nobuhiko Ohguchi, Tokyo (JP); Wataru Kokubo, Tokyo (JP); Kenichi Hirano, Saitama (JP); Toshihiro Kusunoki, Tokyo (JP)

(73) Assignee: Sony Corporation, Tokyo (JP)

( * ) Notice: Subject to any disclaimer, the term of this patent is extended or adjusted under 35 U.S.C. 154(b) by 784 days.

(21) Appl. No.: 12/231,558

(22) Filed: Sep. 4, 2008

(65) Prior Publication Data

US 2009/0067662 A1 Mar. 12, 2009

(30) Foreign Application Priority Data

Sep. 6, 2007 (JP) ..... 2007-232014

(51) Int. Cl.
*H04R 1/02* (2006.01)

(52) U.S. Cl. ..... 381/386; 381/395

(58) Field of Classification Search ..... 381/189, 381/386, 336; 181/199
See application file for complete search history.

(56) References Cited

U.S. PATENT DOCUMENTS

| | | | | |
|---|---|---|---|---|
| 5,172,092 | A * | 12/1992 | Nguyen et al. | 340/7.58 |
| 7,116,795 | B2 * | 10/2006 | Tuason et al. | 381/386 |
| 2004/0154130 | A1 * | 8/2004 | Lee et al. | 16/330 |

FOREIGN PATENT DOCUMENTS

| | | | |
|---|---|---|---|
| CN | 2315623 | Y | 4/1999 |
| CN | 1983142 | A | 6/2007 |
| JP | 2006-314065 | A | 11/2006 |

* cited by examiner

*Primary Examiner* — Davetta W Goins
*Assistant Examiner* — Amir Etesam
(74) *Attorney, Agent, or Firm* — Wolf, Greenfield & Sacks, P.C.

(57) ABSTRACT

A speaker unit includes: a speaker that contains a magnet for vibrating a diaphragm to output sound; a speaker housing unit that houses the speaker so that the front of the diaphragm is exposed outside; an opening-and-closing unit that is attached to the speaker housing unit so that the opening-and-closing unit can both open, with respect to the speaker housing unit, to expose the front of the diaphragm outside and close to cover the front of the diaphragm; and a metallic component that is, when the opening-and-closing unit is closed with respect to the speaker housing unit, attracted to the magnet of the speaker to pull the opening-and-closing unit in a closing direction.

6 Claims, 11 Drawing Sheets

SPEAKER UNIT AND AUDIO OUTPUT ROBOT DEVICE

CROSS REFERENCES TO RELATED APPLICATIONS

The present invention contains subject matter related to Japanese Patent Application JP2007-232014 filed in the Japanese Patent Office on Sep. 6, 2007, the entire contents of which being incorporated herein by reference.

BACKGROUND OF THE INVENTION

1. Field of the Invention

The present invention relates to a speaker unit and audio output robot device, and is preferably applied to an audio robot device which has a function of outputting music, for example.

2. Description of the Related Art

As disclosed in Jpn. Pat. Laid-open Publication No. 2006-314065, a typical audio robot device includes a speaker, a housing unit, which houses a speaker and its diaphragm, and an opening-and-closing unit. The diaphragm is exposed from the housing unit, and can be covered by the opening-and-closing unit when the opening-and-closing is closed. The audio robot device can move, as if dancing to the music output from the speaker, by opening and closing the opening-and-closing unit with respect to the housing unit, and thereby expose and cover the diaphragm.

SUMMARY OF THE INVENTION

The above audio robot device is equipped with a motor, which is to open and close the opening-and-closing unit with respect to the housing unit, a plurality of gears, and a rotational shaft. The rotational shaft is attached to the opening-and-closing unit.

The motor's power is conveyed to the rotational shaft through the gears, thereby rotating the opening-and-closing unit, which attached to the rotational shaft, in a closing and opening direction, with respect to the housing unit.

By closing the opening-and-closing unit with respect to the housing unit, the speaker's diaphragm is covered by the opening-and-closing unit.

Here, if each gear has a slightly distorted shape due to the imprecision of manufacturing processes, there may be a small gap between the gears meshing with one another (this gap is also referred to as "meshing gap").

Because of the meshing gap, there is a possibility that the opening-and-closing unit, a purpose of which is to protect the speaker, can not be closed completely with respect to the housing unit with an opening left between the opening-and-closing unit and the housing unit.

In such a case, if a user's finger accidentally got caught in the opening, the opening-and-closing unit can be opened completely with the diaphragm of the speaker exposed.

Accordingly, it is difficult to say that the speaker is appropriately protected.

The present invention has been made in view of the above points and is intended to provide a speaker unit and audio output robot device that can protect a speaker.

In one aspect of the invention, a speaker unit includes: a speaker that contains a magnet for vibrating a diaphragm to output sound; a speaker housing unit that houses the speaker so that the front of the diaphragm is exposed outside; an opening-and-closing unit that is attached to the speaker housing unit so that the opening-and-closing unit can both open, with respect to the speaker housing unit, to expose the front of the diaphragm outside and close to cover the front of the diaphragm; and a metallic component that is, when the opening-and-closing unit is closed with respect to the speaker housing unit, attracted to the magnet of the speaker to pull the opening-and-closing unit in a closing direction.

The metallic component, which pulls the opening-and-closing unit in the closing direction, can keep the opening-and-closing unit closed with respect to the speaker housing unit.

According to an embodiment of the present invention, a speaker unit includes: a speaker that contains a magnet for vibrating a diaphragm to output sound; a speaker housing unit that houses the speaker so that the front of the diaphragm is exposed outside; an opening-and-closing unit that is attached to the speaker housing unit so that the opening-and-closing unit can both open, with respect to the speaker housing unit, to expose the front of the diaphragm outside and close to cover the front of the diaphragm; and a metallic component that is, when the opening-and-closing unit is closed with respect to the speaker housing unit, attracted to the magnet of the speaker to pull the opening-and-closing unit in a closing direction. The metallic component, which pulls the opening-and-closing unit in the closing direction, can keep the opening-and-closing unit closed with respect to the speaker housing unit. Thus, the speaker unit can protect the speaker.

The nature, principle and utility of the invention will become more apparent from the following detailed description when read in conjunction with the accompanying drawings in which like parts are designated by like reference numerals or characters.

DETAILED DESCRIPTION OF PREFERRED EMBODIMENTS

An embodiment of the present invention will be described in detail with reference to the accompanying drawings.

(1) Mechanical Configuration of Audio Robot Device

Figure 1A:
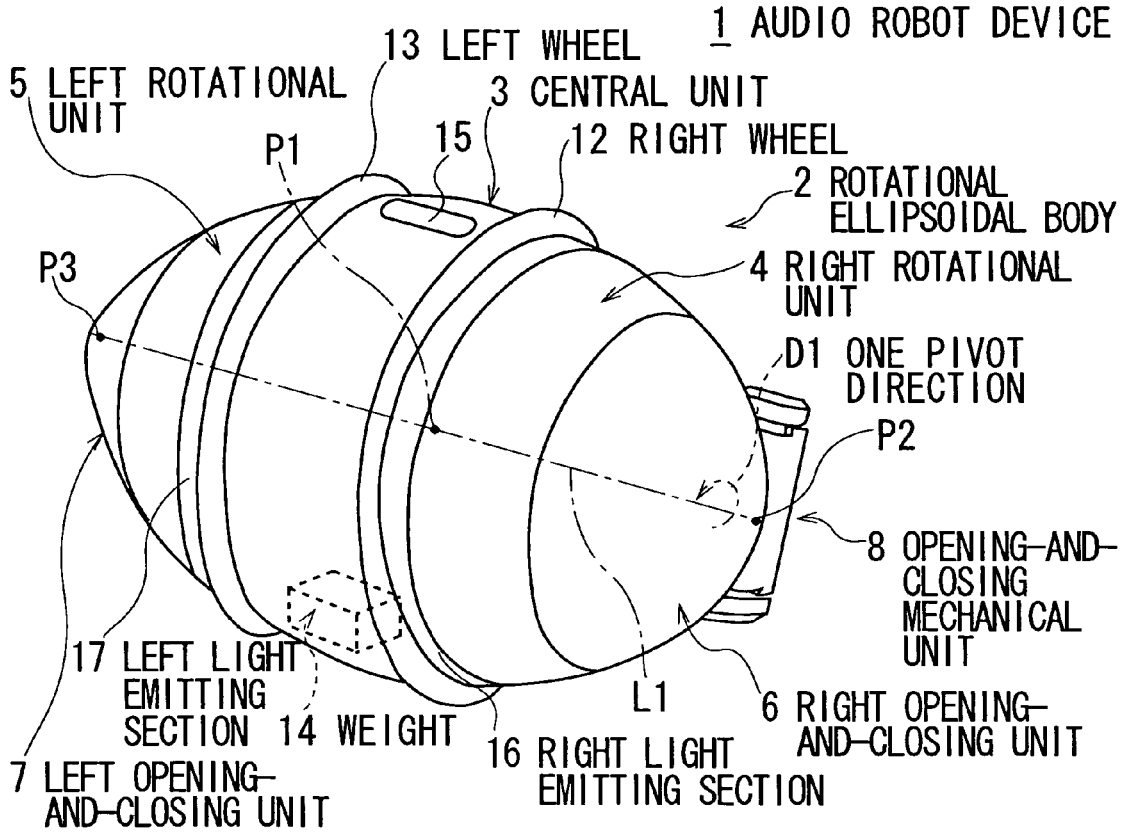
FIG. 1 is a schematic perspective view of an audio robot device.
Figure 1B:
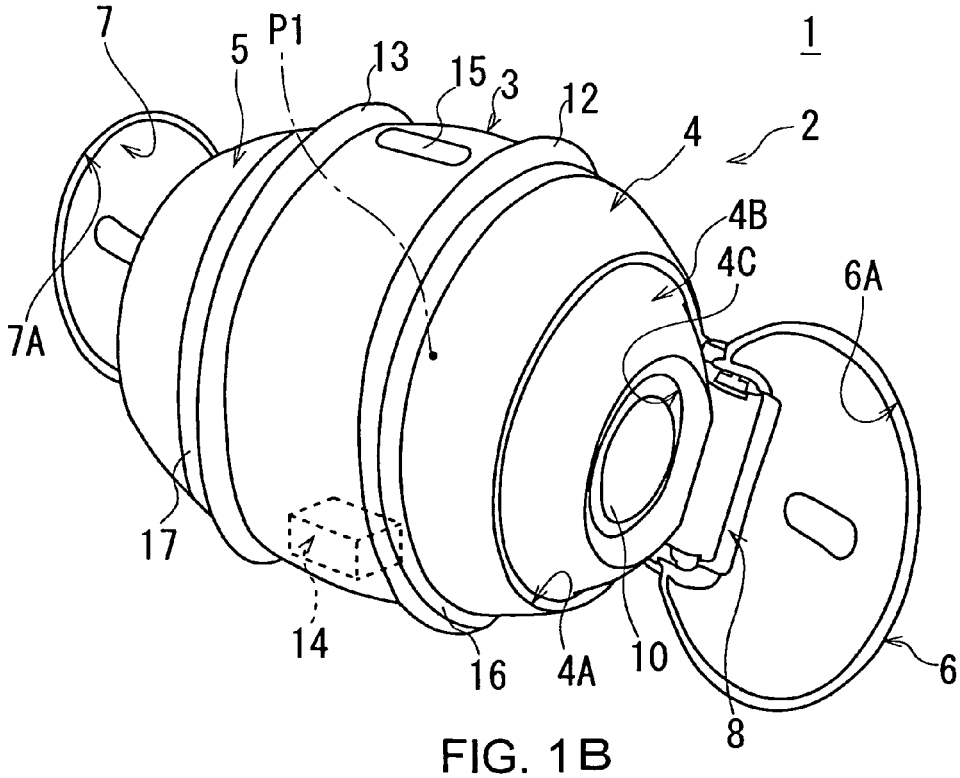
Figure 2:
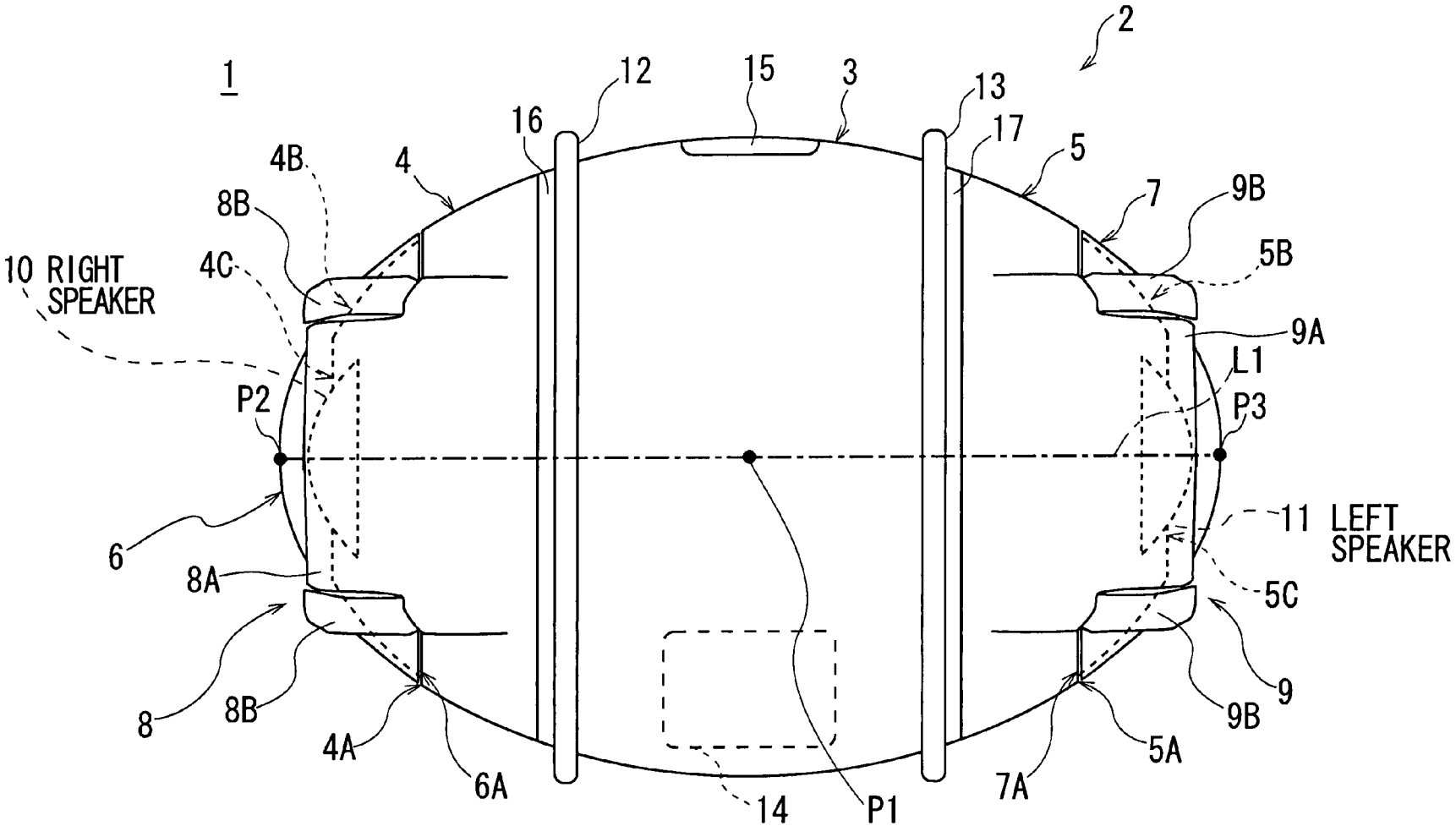
FIG. 2 is a schematic diagram illustrating the configuration of the back of the audio robot device.

In FIGS. 1A, 1B, and 2, the reference numeral 1 denotes an audio robot device as a whole, according to an embodiment of the present invention.

The audio robot device 1 includes a substantially ellipsoidal body 2 as a whole, for example. The ellipsoidal body 2 is also referred to as a "rotational ellipsoidal body."

The rotational ellipsoidal body 2 includes a substantially barrel-shaped central unit 3, the right end of which is attached to a first rotational unit (also referred to as a "right rotational unit") 4 which is substantially conical with its head part cut off.

The left end of the central unit 3 is attached to a second rotational unit (also referred to as "left rotational unit") 5 which is substantially formed conical with its head part cut off.

The right side of the right rotational unit 4 is attached to a first opening-and-closing unit (also referred to as "right opening-and-closing unit) 6 which is substantially dome-shaped.

The left side of the left rotational unit 5 is attached to a second opening-and-closing unit (also referred to as "left opening-and-closing unit) 7 which is substantially dome-shaped.

By the way, an imaginary line segment joining the right and left points P2 and P3 is also referred to as a horizontal rotational shaft line L1: P2 and P3 are the farthest points on the surface of the rotational ellipsoidal body 2 from the center P1 of the rotational ellipsoidal body 2.

The right rotational section 4 is held by a shaft so that it can rotate 320 degrees around the horizontal rotational shaft line L1 with respect to the central unit 3 in one pivot direction D1 or the other pivot direction.

The left rotational section 5 is held by a shaft so that it can rotate 320 degrees around the horizontal rotational shaft line L1 with respect to the central unit 3 in one pivot direction D1 or the other pivot direction.

Figure 3:
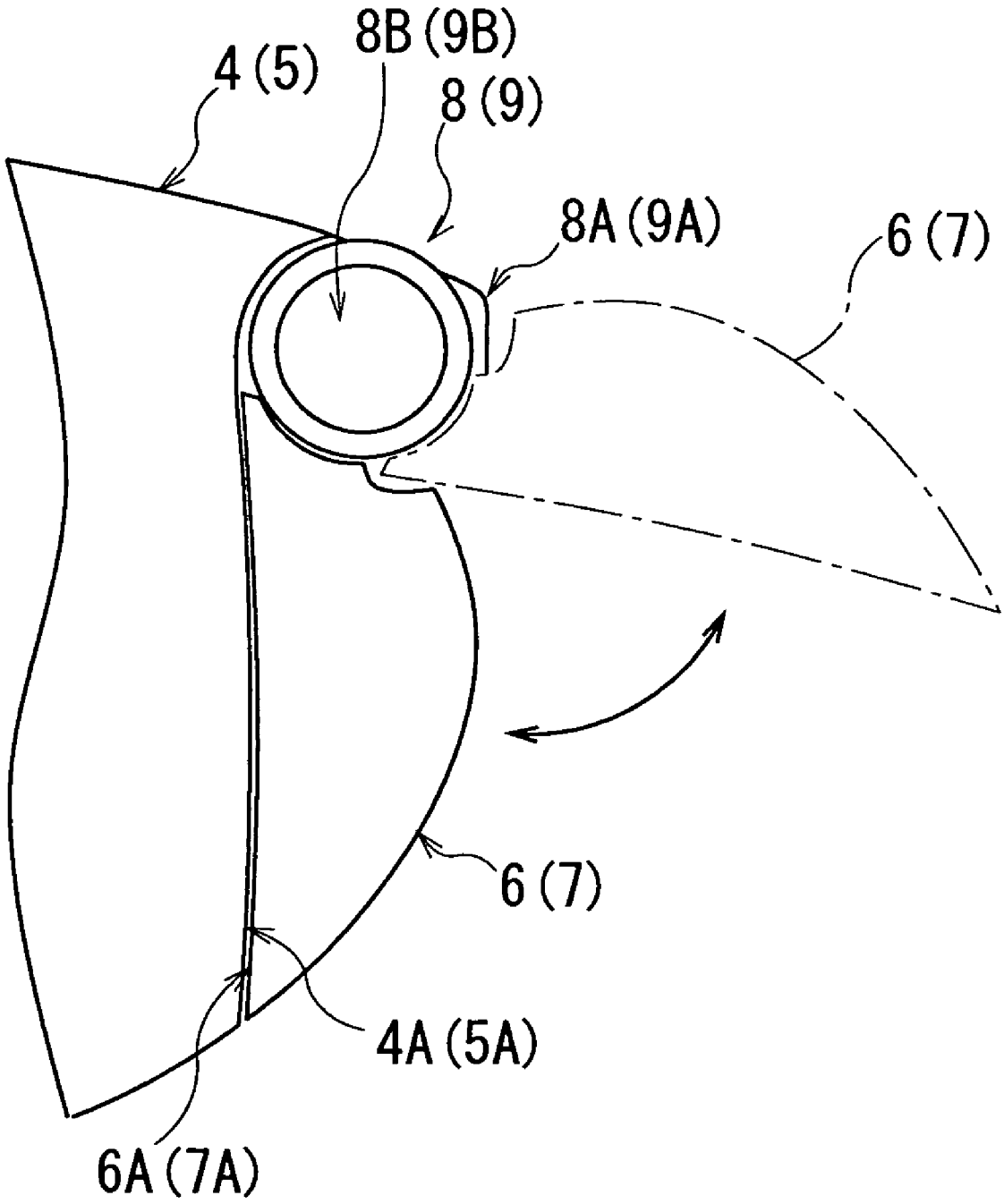
FIG. 3 is a schematic diagram illustrating how right and left opening-and-closing units open and close with respect to right and left rotational units.

As shown in FIG. 3, the right opening-and-closing unit 6 is attached to the right rotational unit 4 via an opening-and-closing mechanical unit 8 that allows the right opening-and-closing unit 6 to rotate within a predetermined range (also referred to as "opening-and-closing range").

In this case, the opening-and-closing range is from a closed angle, at which the right-side edge 4A of the right rotational section 4 touches the left-side edge 6A of the right opening-and-closing unit 6 (i.e., the right opening-and-closing unit 6 is closed with respect to the right rotational section 4), to approximately 80 degrees, at which the right opening-and-closing unit 6 is completely opened with respect to the right rotational section 4.

The right opening-and-closing unit 6 is driven by a motor (not shown) housed in the opening-and-closing mechanical unit 8, and is therefore opened and closed. Therefore, the right opening-and-closing unit 6 can be rotated in the opening and closing directions within the opening-and-closing range.

The left opening-and-closing unit 7 is attached to the left rotational unit 5 via an opening-and-closing mechanical unit 9 that allows the left opening-and-closing unit 7 to rotate within opening-and-closing range.

In this case, the opening-and-closing range is from a closed angle, at which the left-side surface 5A of the left rotational section 5 touches the left-side surface 7A of the left opening-and-closing unit 7 (i.e., the left opening-and-closing unit 7 is closed with respect to the left rotational section 5), to approximately 80 degrees, at which the left opening-and-closing unit 7 is completely opened with respect to the left rotational section 5.

The left opening-and-closing unit 7 is driven by a motor (not shown) housed in the opening-and-closing mechanical unit 9. Therefore, the left opening-and-closing unit 7 can be rotated in the opening and closing directions within the opening-and-closing range.

The right-side surface unit 4B of the right rotational section 4 protrudes like a mountain, at the summit of which a hole section 4C is formed like a pipe.

The device 1 has a pair of stereo speakers (first and second speakers) 10 and 11 that have the same shape and configuration. A right speaker 10 is housed in the right rotational section 4, and a part of the right speaker, or the front of a dome-shaped diaphragm, extends outside through the hole section 4C.

When the right opening-and-closing unit 6 is closed by the opening-and-closing mechanical unit 8 with respect to the right rotational unit 4, the right opening-and-closing unit 6 covers the diaphragm of the right speaker 10 to protect it.

When the right opening-and-closing unit 6 is opened by the opening-and-closing mechanical unit 8 with respect to the right rotational unit 4, the diaphragm of the right speaker 10 is exposed.

The left-side surface 5B of the left rotational section 5 protrudes like a mountain, at the summit of which a hole section 5C is formed like a pipe.

The left speaker 11 is housed in the left rotational section 5, and a part of the left speaker, or the front of a dome-shaped diaphragm, extends outside through the hole section 5C.

When the left opening-and-closing unit 7 is closed by the opening-and-closing mechanical unit 9 with respect to left rotational unit 5, the left opening-and-closing unit 7 covers the diaphragm of the left speaker 11 to protect it.

When the left opening-and-closing unit 7 is opened by the opening-and-closing mechanical unit 9 with respect to left rotational unit 5, the diaphragm of the left speaker 11 is exposed.

Figure 4:
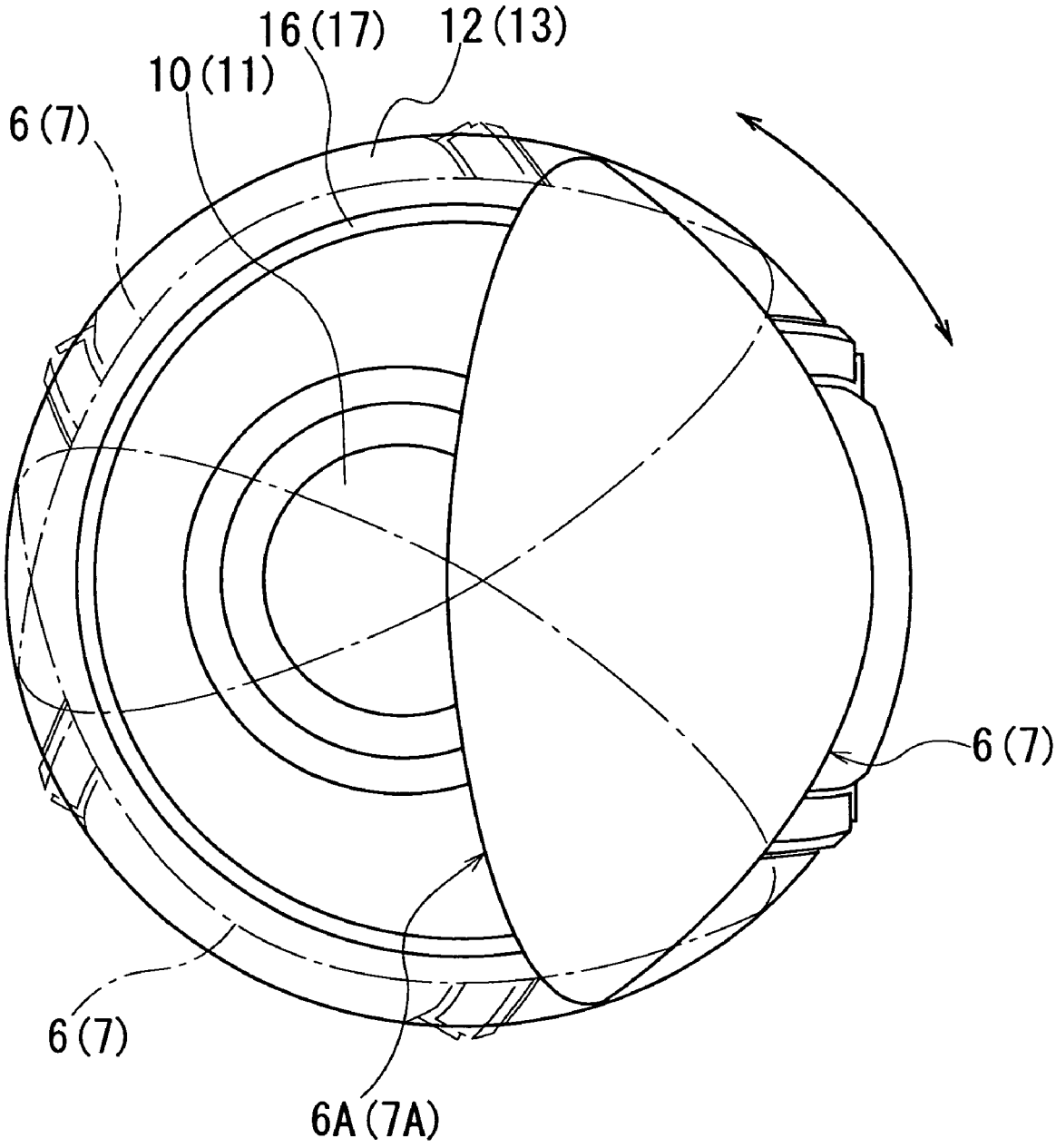
FIG. 4 is a schematic diagram illustrating the rotation of right and left rotational units.

As shown in FIG. 4, the right rotational unit 4 rotates separately from the left rotational unit 5.

The right rotational unit 4 also works separately from the right opening-and-closing unit 6, which is opened and closed. Moreover, the left rotational unit 5 works separately from the left opening-and-closing unit 7.

Furthermore, as shown in FIGS. 1A, 1B, and 2, a ring-shaped right wheel 12 is provided around the right edge of the central unit 3; the right wheel 12 is held by a shaft so that it can rotate around the horizontal rotational shaft line L1 in the one pivot direction D1 or the other pivot direction.

Furthermore, a left wheel 13 that is formed in the same shape as the right wheel 12 is provided around the left edge of the central unit 3; the left wheel 13 is held by a shaft so that it can rotate around the horizontal rotational shaft line L1 in the one pivot direction D1 or the other pivot direction.

In this case, the outer diameter of the right and left wheels 12 and 13 is larger than that of the central unit 3.

This allows the right and left wheels 12 and 13, which can rotate in the one pivot direction D1 and the other pivot direction, to carry the rotational ellipsoidal body 2 on a table.

The right and left wheels 12 and 13 can be controlled separately. By driving the right and left wheels 12 and 13 at different speeds or in different directions, the rotational ellipsoidal body 2 moves in various manners, including circling around.

Moreover, a weight 14 is situated at a predetermined position inside the central unit 3: the weight 14, such as a battery, is firmly attached to the inner wall of the unit 3.

As for the central unit 3, the distance from the center point P1 to the right edge (or the right wheel 12) is substantially equal to the distance from the center point P1 to the left edge (or the left wheel 12).

The right rotational unit 4 and the left rotational unit 5 are formed in the same shape and size.

The right opening-and-closing unit 6 and the left opening-and-closing unit 7 are formed in the same shape and size: the distance from the left-side edge 6A to the surface's summit P2 is substantially equal to the distance from right-side edge 7A to the surface's summit P3.

Therefore, the rotational ellipsoidal body 2 is symmetrical about an imaginary plane (not shown) drawn in such a way that it passes through the center point P1 and is perpendicular to the horizontal rotational shaft line L1.

Accordingly, when the rotational ellipsoidal body 2 is put on a table or floor, the central unit 3 does not touch the table or floor, being a little above the table top: the rotational ellipsoidal body 2 is kept by the right and left wheels 12 and 13 with the horizontal rotational shaft line L1 parallel to the table's surface.

By the way, hereinafter, assume that the rotational ellipsoidal body 2 will be put on a floor.

Thanks to the weight 14 situated inside the central unit 3, the center of gravity of the central unit 3 is closer to the inner wall than to the center point P1.

When the rotational ellipsoidal body 2 is put on the floor, it takes a basic attitude in which case the weight 14 is positioned at the bottom.

Since the weight 14 is appropriately selected and therefore relatively heavy, the rotational ellipsoidal body 2 on the floor maintains the basic attitude without swaying to the left or right, even when the right opening-and-closing unit 6 and the left opening-and-closing unit 7 are working separately.

The rotational ellipsoidal body 2 on the floor maintains the basic attitude without swaying to the left or right, even when the right rotational unit 4 and the left rotational unit 5, and the right opening-and-closing unit 6 and the left opening-and-closing unit 7 are working separately.

As mentioned above, thanks to the weight 14, the center of gravity of the central unit 3 is closer to the inner wall than to the center point P1.

This keeps the central unit 3 from rotating around the line L1 in one pivot direction D1 or the other pivot direction, even when the rotational ellipsoidal body 2 is running on the floor.

Thanks to the relatively heavy weight 14, the rotational ellipsoidal body 2 running on the floor can maintain the basic attitude without swaying to the left or right, even when the right opening-and-closing unit 6 and the left opening-and-closing unit 7 are working separately.

Moreover, the rotational ellipsoidal body 2 running on the floor can maintain the basic attitude without swaying to the left or right, even when the right rotational unit 4 and the left rotational unit 5, and the right opening-and-closing unit 6 and the left opening-and-closing unit 7 are working separately.

On the surface of the central unit 3, a touch detection sensor 15 is provided: the touch detection sensor 15 is shaped like an oval track (for athletics), and is placed at the opposite side to the weight 14. The touch detection sensor 15 detects a finger or hand put thereon.

On the right side of the right wheel 12, a ring-shaped right light emitting unit 16 is provided: the light emitting unit 16 emits light. On the left side of the left wheel 13, a ring-shaped left light emitting unit 17 is provided: the left light emitting unit 17 has the same configuration as the unit 16.

The right light emitting unit 16 and left light emitting unit 17 are illuminated in various ways: only the part, or sometimes the entire part, may be illuminated in different colors.

In addition, as shown in FIGS. 2 and 3, the opening-and-closing mechanical unit 8 includes a main body unit 8A and a pair of pinching units 8B. The main body unit 8A is firmly attached to the right-side surface unit 4B of the right rotational unit 4; the pinching units 8B are firmly attached to the right opening-and-closing unit 6 as if pinching the main body unit 8A.

The main body unit 8A includes a motor, a plurality of gears, and a rotational shaft (not shown). The motor's power is conveyed to the rotational shaft via the gears. As a result, the rotational shaft rotates to open and close the right opening-and-closing unit 6 with respect to the right rotational unit 4.

Figure 5A:
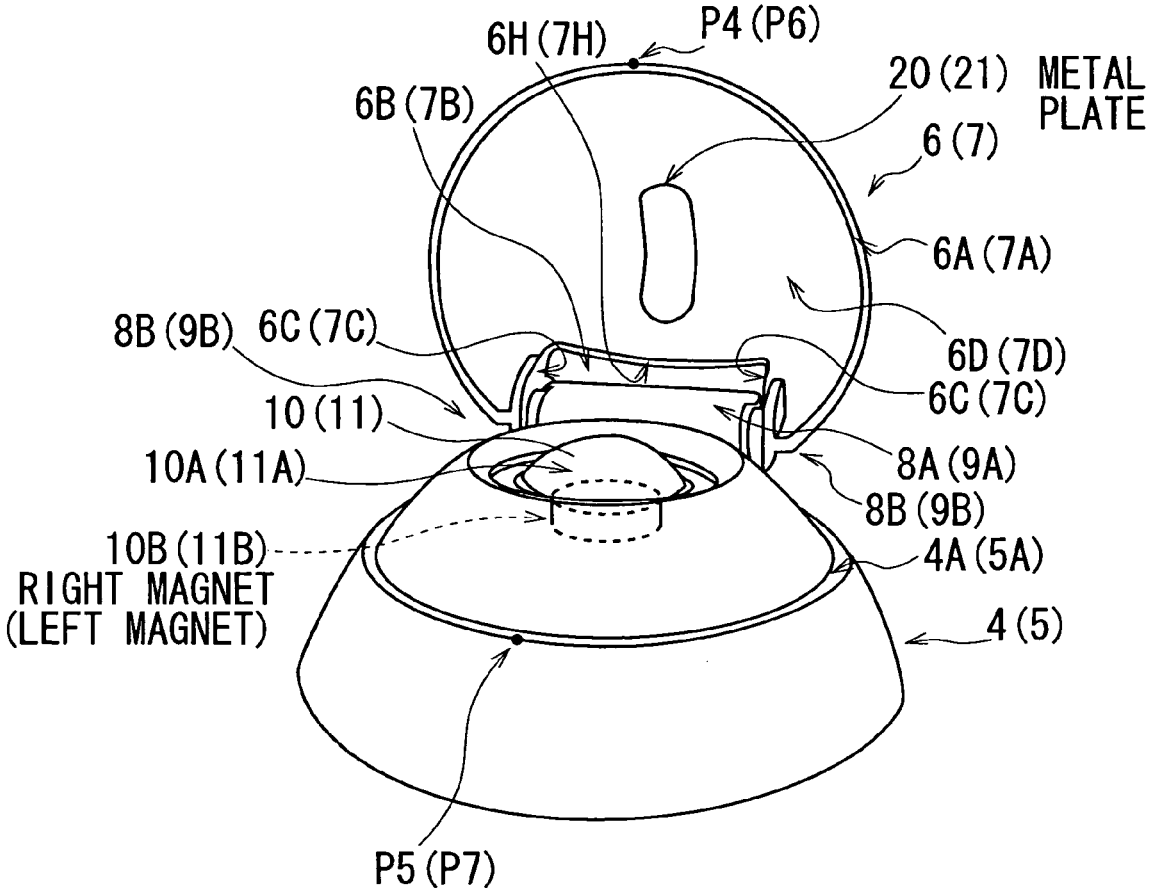
FIG. 5 is a schematic perspective view of a device to illustrate how a metal plate and a magnet are arranged.
Figure 5B:
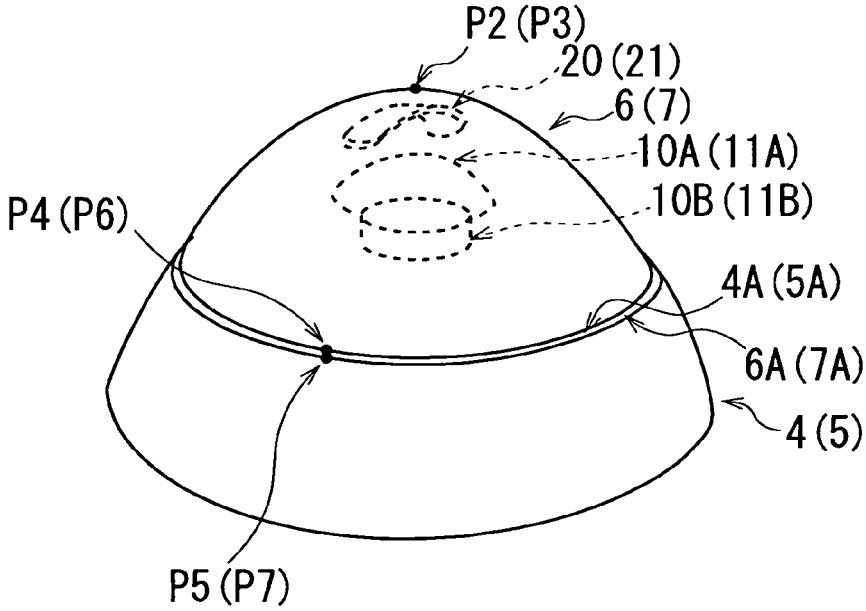
Figure 6A:
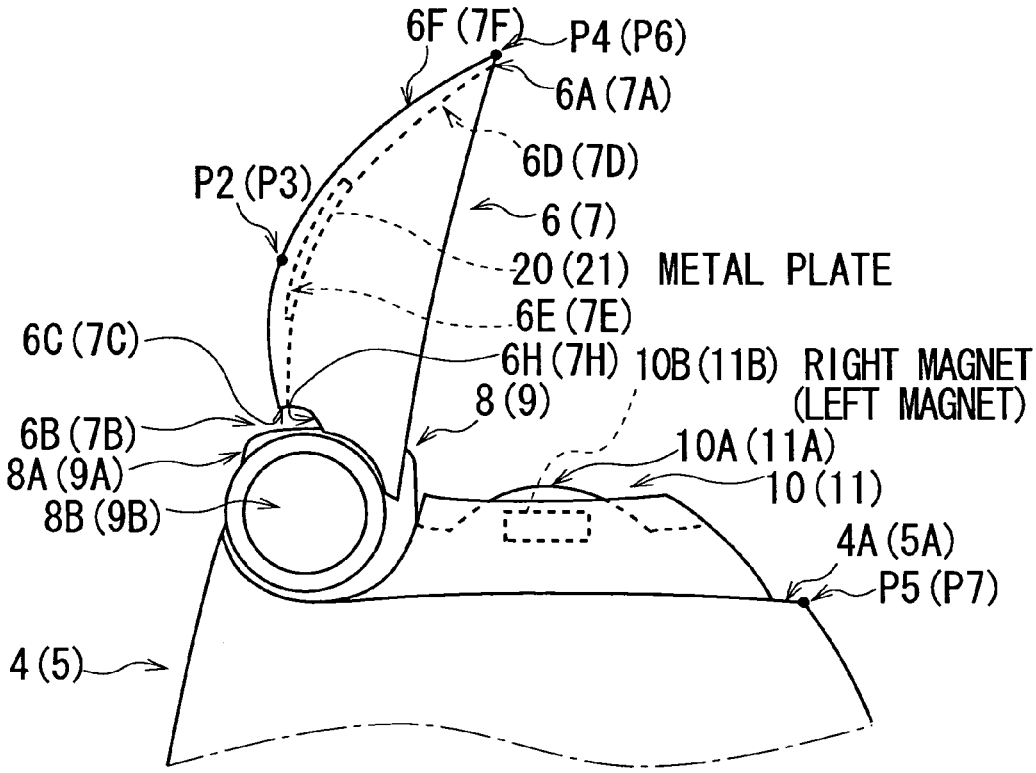
FIG. 6 is a schematic diagram illustrating how a metal plate and a magnet are arranged.
Figure 6B:
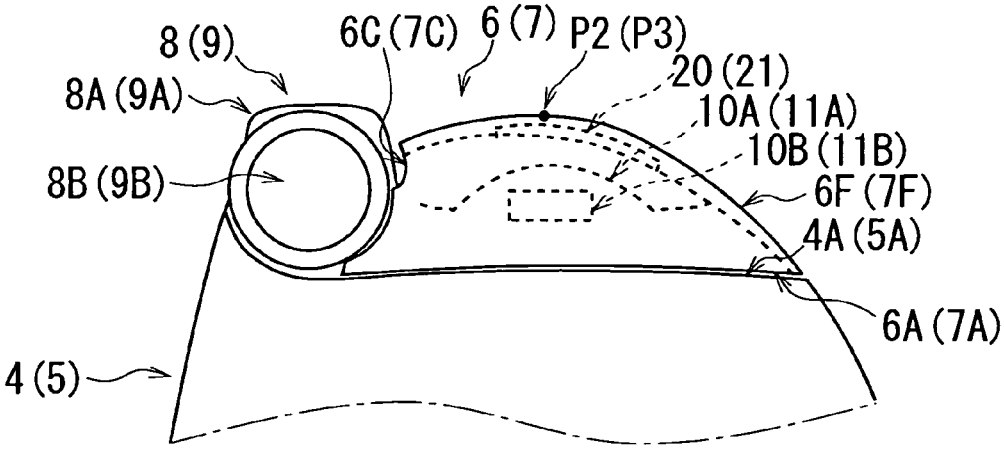

As shown in FIGS. 5A and 5B, on the right opening-and-closing unit 6, a cut-off section 6B is formed by cutting off a rectangular piece from the edge of the right opening-and-closing unit 6 in a direction of a line connecting the edge 6A and the summit P2.

The cut-off section 6B has a pair of sides (also referred to as "cut-off-direction sides") 6C, which face one another and are parallel to one another, and a side (also referred to as "cut-off side") 6H, which is perpendicular to the sides 6C.

The pinching units 8B are firmly attached to the cut-off-direction sides 6C of the right opening-and-closing unit 6 so that they can hold the main body unit 8A by supporting the ends of the rotational shaft of the main body section 8A.

Accordingly, as for the right opening-and-closing unit 6, as shown in FIGS. 5A, 5B, 6A, and 6B, the pinching sections 8B are attached to the rotational shaft of the main body unit 8A by supporting the ends of the rotational shaft of the main body unit 8A. Accordingly, when the rotational shaft is rotated by the motor, the right opening-and-closing unit 6 can rotate within the opening-and-closing range, and is therefore opened and closed with respect to the rotational unit 4.

The closed right opening-and-closing unit 6 covers the diaphragm of the right speaker 10, which is exposed from the rotational unit 4 through the hole section 4C, to protect it.

The opening-and-closing mechanical unit 9 includes a main body unit 9A and a pair of pinching units 9B. The main body unit 9A is firmly attached to the left-side surface unit 5B of the left rotational unit 5; the pinching units 9B are firmly attached to the left opening-and-closing unit 7 as if pinching the main body unit 9A.

The main body unit 9A includes a motor, a plurality of gears, and a rotational shaft (not shown). The motor's power is conveyed to the rotational shaft via the gears. As a result, the rotational shaft rotates to open and close the left opening-and-closing unit 7 with respect to the left rotational unit 5.

As shown in FIG. 5A, on the left opening-and-closing unit 7, a cut-off section 7B is formed by cutting off a rectangular piece from the edge of the left opening-and-closing unit 7 in a direction of a line connecting the edge 7A and the summit P3.

The cut-off section 7B has a pair of sides (also referred to as "cut-off-direction sides") 7C, which face one another and are parallel to one another, and a side (also referred to as "cut-off side") 7H, which is perpendicular to the sides 7C.

The pinching units 9B are firmly attached to the cut-off-direction sides 7C of the left opening-and-closing unit 7 so that they can hold the main body unit 9A by supporting the ends of the rotational shaft of the main body section 9A.

Accordingly, as for the left opening-and-closing unit 7, the pinching sections 9B are attached to the rotational shaft of the main body unit 9A by supporting the ends of the rotational shaft of the main body unit 9A. Accordingly, when the rotational shaft is rotated by the motor, the left opening-and-closing unit 7 can rotate within the opening-and-closing range, and is therefore opened and closed with respect to the rotational unit 5.

The closed left opening-and-closing unit 7 covers the diaphragm of the left speaker 11, which is exposed from the rotational unit 5 through the hole section 5C, to protect it.

The right speaker 10 includes, behind the right diaphragm 10A, a right magnet 10B and a right coil (not shown). The right coil is connected to the right diaphragm 10A.

The supply of electric signals to the right coil produces a magnetic force, which is affected by the magnetic force of the magnetic flux of the right magnet 10B. As the electric signals change, the magnetic force produced from the right coil change accordingly, and is therefore affected by the magnetic force of the magnetic flux of the right magnet 10B in a different manner. This causes the right diaphragm 10A to vibrate.

In this manner, as the electric signals change, the right diaphragm 10A vibrates, and thereby outputs sound from the right speaker 10.

The left speaker 11 includes, behind the left diaphragm 11A, a left magnet 11B and a left coil (not shown). The left coil is connected to the left diaphragm 11A.

The supply of electric signals to the left coil produces a magnetic force, which is affected by the magnetic force of the magnetic flux of the left magnet 11B. As the electric signals change, the magnetic force produced from the left coil change accordingly, and is therefore affected by the magnetic force of the magnetic flux of the left magnet 11B in a different manner. This causes the left diaphragm 11A to vibrate.

In this manner, as the electric signals change, the left diaphragm 11A vibrates, and thereby outputs sound from the left speaker 11.

As shown in FIGS. 5A, 5B, 6A, and 6B, on the inner wall 6D of the opening-and-closing unit 6, a concave section 6E is formed. The concave section 6E is shaped like an oval track.

The direction of the long side of the concave section 6E is parallel to the cut-off-direction side 6C.

An oval-track-shaped metal plate 20 is placed in the concave section 6E of the opening-and-closing unit 6. The metal plate 20 is made of metal materials, such as iron, which acts on the magnetic force of the magnet.

The metal plate 20 is curved in the same way as the center of the opening-and-closing unit 6. The size of the metal plate 20 is a little smaller than the concave section 6E, and the thickness of the metal plate 20 is slightly larger than the depth of the concave section 6E.

The metal plate 20 is placed in the concave section 6E so that it slightly protrudes from the concave section 6E of the opening-and-closing unit 6.

By the way, the magnetic flux of the right magnet 10B of the right speaker 10 may leak and spread from the front of the right diaphragm 10A.

When the opening-and-closing unit 6 is closed with respect to the right rotational unit 4, the metal plate 20 is positioned a little above the front of the right diaphragm 10A of the right speaker 10.

Furthermore, the size and position of the metal plate 20 attached to the opening-and-closing unit 6 is determined so that, when the opening-and-closing unit 6 is positioned within a predetermined opening-and-closing range, the metal plate 20 can act on the leak of magnetic flux from the right magnet 10B: the predetermined opening-and-closing range is from zero degree, at which the opening-and-closing unit 6 is completely closed with respect to the rotational unit 4, to a predetermined angle, at which opening-and-closing unit 6, for example, is slightly opened with respect to the rotational unit 4 so that the distance between the point P4 of the opening-and-closing unit 6 and the corresponding point P5 of the rotational unit 4 is around 1 mm. The point P4 is positioned on the opposite side of the opening-and-closing unit 6's periphery (or the edge 6A) from the midpoint of the cut-off side 6H; the point P5 is positioned on the edge 4A of the rotational unit 4, and come in contact with the point P4 when the opening-and-closing unit 6 is closed.

Thanks to the leak of magnetic flux of the right magnet 10B, the magnet plate 20 is attracted toward the right magnet 10B, thereby closing the opening-and-closing unit 6.

Accordingly, when the rotational ellipsoidal body 2 is held and carried by a user's hand with the opening-and-closing unit 6 closed, the opening-and-closing unit 6 does not open with respect to the rotational units 4 even if the rotational ellipsoidal body 2 is shaken or hit.

Accordingly, after the opening-and-closing unit 6 is closed with respect to the rotational unit 4, the leak of magnetic flux of the right magnet 10B acts on the metal plate 20, and attracts the metal plate 20 in the closing direction. This keeps the opening-and-closing unit 6 from opening.

There was a possibility that the opening-and-closing unit 6 can not be closed completely with respect to the rotational unit 4 because of the meshing gap of the gears of the opening-and-closing mechanical unit 8. But in the above configuration, the opening-and-closing unit 6 can be closed completely with respect to the rotational unit 4.

Therefore, the above configuration can avoid the following case: if a user's finger accidentally got caught in the opening between the opening-and-closing unit 6 and the rotational unit 4, the opening-and-closing unit 6 can be opened completely with the diaphragm 10A of the speaker 10 exposed. Thus, the diaphragm 10A of the speaker 10 is protected.

Moreover, the size and position of the metal plate 20 attached to the opening-and-closing unit 6 is determined so that, only within the small opening-and-closing range, the metal plate 20 acts on the leak of magnetic flux from the right magnet 10B. This puts little burden on the opening-and-closing mechanical unit 8's motor that rotates to open and close the opening-and-closing unit 6.

In this manner, the metal plate 20 and the right magnet 10B put little burden on the motor, and thereby cut-down on power consumption.

Furthermore, even when the rotational ellipsoidal body 2 is carried with the opening-and-closing unit 6 facing downward, the opening-and-closing unit 6 does not open by itself.

Accordingly, the opening-and-closing unit 6 can appropriately covers the right diaphragm 10A of the right speaker 10, thereby protecting the right diaphragm 10A.

Furthermore, even if it was not closed completely, the right and left opening-and-closing unit 6 will be automatically closed when it reaches the predetermined opening-and-closing range thanks to the leak of magnetic flux from the speaker 10 and the metal plate 20.

This ensures that the opening-and-closing unit 6 is closed completely with respect to the rotational unit 4, and therefore prevents the following case: a user's finger or something got caught in the opening between the opening-and-closing unit 6 and the rotational unit 4, and the audio robot device 1 drops from a table or something.

By the way, the audio robot device 1 can output music from the right speaker 10 even when the opening-and-closing unit 6 is closed with respect to the rotational unit 4.

If the opening-and-closing unit 6 is slightly opened with respect to the rotational unit 4, the opening-and-closing unit 6 vibrates as the right diaphragm 10A of the right speaker 10 vibrates, and thereby outputs noise (also referred to as "vibration sound").

However, the above configuration makes sure the opening-and-closing unit 6 is completely closed with respect to the rotational unit 4. Therefore, the vibration of the opening-and-closing unit 6 is absorbed by the rotational unit 4, thereby eliminating the vibration sound.

The material of the opening-and-closing unit 6 is thicker around the summit P2 than the edge 6A, thereby preventing the rotational ellipsoidal body 2 from breakage even if the rotational ellipsoidal body 2 is dropped with the opening-and-closing unit 6 facing downward.

Since the concave section 6E is formed around the center of the inner wall 6D of the opening-and-closing unit 6, the center of the opening-and-closing unit 6 is relatively thin. However, the metal plate 20 gives the concave section 6E enough strength to endure falling shock.

On the inner wall 7D of the opening-and-closing unit 7, a concave section 7E is formed. The concave section 7E is shaped like an oval track.

The direction of the long side of the concave section 7E is parallel to the cut-off-direction side 7C.

An oval-track-shaped metal plate 21 is placed in the concave section 7E of the opening-and-closing unit 7. The metal plate 21 is made of metal materials, such as iron, which acts on the magnetic force of the magnet.

The metal plate 21 is curved in the same way as the center of the opening-and-closing unit 7. The size of the metal plate 21 is a little smaller than the concave section 7E, and the thickness of the metal plate 21 is slightly larger than the depth of the concave section 7E.

The metal plate 21 is placed in the concave section 7E so that it slightly protrudes from the concave section 7E of the opening-and-closing unit 7.

By the way, the magnetic flux of the left magnet 11B of the left speaker 11 may leak and spread from the front of the left diaphragm 11A.

When the opening-and-closing unit 7 is closed with respect to the right rotational unit 5, the metal plate 21 is positioned a little above the front of the left diaphragm 11A of the left speaker 11.

Furthermore, the size and position of the metal plate 21 attached to the opening-and-closing unit 7 is determined so that, when the opening-and-closing unit 7 is positioned within a predetermined opening-and-closing range, the metal plate 21 can act on the leak of magnetic flux from the left magnet 11B: the predetermined opening-and-closing range is from zero degree, at which the opening-and-closing unit 7 is completely closed with respect to the rotational unit 5, to a predetermined angle, at which opening-and-closing unit 7, for example, is slightly opened with respect to the rotational unit 5 so that the distance between the point P6 of the opening-and-closing unit 7 and the corresponding point P7 of the rotational unit 5 is around 1 mm. The point P6 is positioned on the opposite side of the opening-and-closing unit 7's periphery (or the edge 7A) from the midpoint of the cut-off side 7H; the point P7 is positioned on the edge 5A of the rotational unit 5, and come in contact with the point P6 when the opening-and-closing unit 7 is closed.

Thanks to the leak of magnetic flux of the left magnet 11B, the magnet plate 21 is attracted toward the left magnet 11B, thereby closing the opening-and-closing unit 7.

Accordingly, when the rotational ellipsoidal body 2 is held and carried by a user's hand with the opening-and-closing unit 7 closed, the opening-and-closing unit 7 does not open with respect to the rotational units 5 even if the rotational ellipsoidal body 2 is shaken or hit.

Accordingly, after the opening-and-closing unit 7 is closed with respect to the rotational unit 5, the leak of magnetic flux of the left magnet 11B acts on the metal plate 21, and attracts the metal plate 21 in the closing direction. This keeps the opening-and-closing unit 7 from opening.

There was a possibility that the opening-and-closing unit 7 can not be closed completely with respect to the rotational unit 5 because of the meshing gap of the gears of the opening-and-closing mechanical unit 9. But in the above configuration, the opening-and-closing unit 7 can be closed completely with respect to the rotational unit 5.

Therefore, the above configuration can avoid the following case: if a user's finger accidentally got caught in the opening between the opening-and-closing unit 7 and the rotational unit 5, the opening-and-closing unit 7 can be opened completely with the diaphragm 11A of the speaker 11 exposed. Thus, the diaphragm 11A of the speaker 11 is protected.

Moreover, the size and position of the metal plate 21 attached to the opening-and-closing unit 7 is determined so that, only within the small opening-and-closing range, the metal plate 21 acts on the leak of magnetic flux from the left magnet 11B. This puts little burden on the opening-and-closing mechanical unit 9's motor that rotates to open and close the opening-and-closing unit 7.

In this manner, the metal plate 21 and the left magnet 11B put little burden on the motor, and thereby cut down on power consumption.

Furthermore, even when the rotational ellipsoidal body 2 is carried with the opening-and-closing unit 7 facing downward, the opening-and-closing unit 7 does not open by itself.

Accordingly, the opening-and-closing unit 7 can appropriately covers the left diaphragm 11A of the left speaker 11, thereby protecting the left diaphragm 11A.

Furthermore, even if it was not closed completely, the right and left opening-and-closing unit 7 will be automatically closed when it reaches the predetermined opening-and-closing range thanks to the leak of magnetic flux from the speaker 11 and the metal plate 21.

This ensures that the opening-and-closing unit 7 is closed completely with respect to the rotational unit 5, and therefore prevents the following case: a user's finger or something got caught in the opening between the opening-and-closing unit 7 and the rotational unit 5, and the audio robot device 1 drops from a table or something.

By the way, the audio robot device 1 can output music from the left speaker 11 even when the opening-and-closing unit 7 is closed with respect to the rotational unit 5.

If the opening-and-closing unit 7 is slightly opened with respect to the rotational unit 5, the opening-and-closing unit 7 vibrates as the left diaphragm 11A of the left speaker 11 vibrates, and thereby outputs noise (also referred to as "vibration sound").

However, the above configuration makes sure the opening-and-closing unit 7 is completely closed with respect to the rotational unit 5. Therefore, the vibration of the opening-and-closing unit 7 is absorbed by the rotational unit 5, thereby eliminating the vibration sound.

The material of the opening-and-closing unit 7 is thicker around the summit P3 than the edge 7A, thereby preventing the rotational ellipsoidal body 2 from breakage even if the rotational ellipsoidal body 2 is dropped with the opening-and-closing unit 7 facing downward.

Since the concave section 7E is formed around the center of the inner wall 7D of the opening-and-closing unit 7, the center of the opening-and-closing unit 7 is relatively thin. However, the metal plate 21 gives the concave section 7E enough strength to endure falling shock.

By the way, the metal plates 20 and 21 are formed in the same shape as the oval-track-shaped touch detection sensor 15.

Accordingly, this design provides a sense of unity, despite the audio robot device 1 having additional components such as the metal plates 20 and 21.

(2) Circuit Configuration of Audio Robot Device

Figure 7:
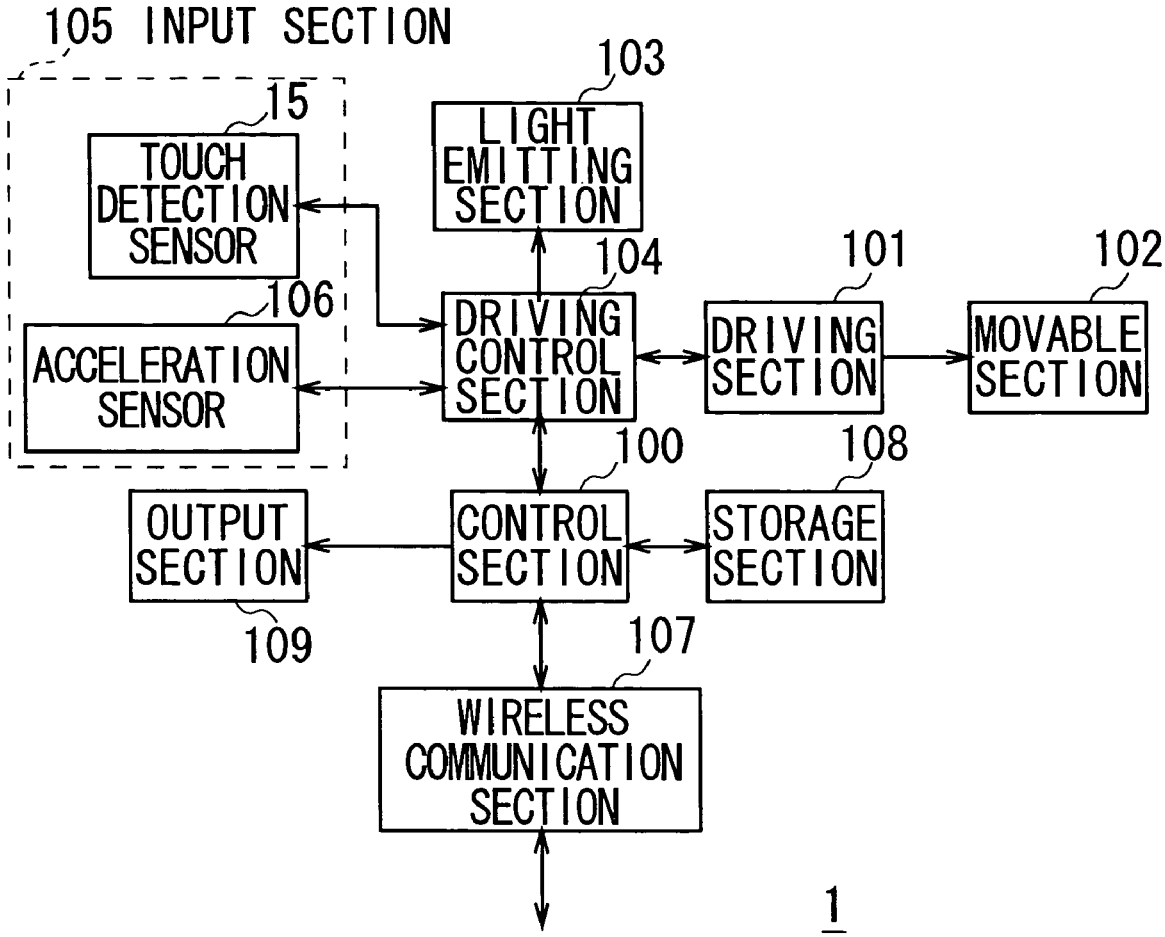
FIG. 7 is a block diagram illustrating the circuit configuration of an audio robot device.
Figure 8A:
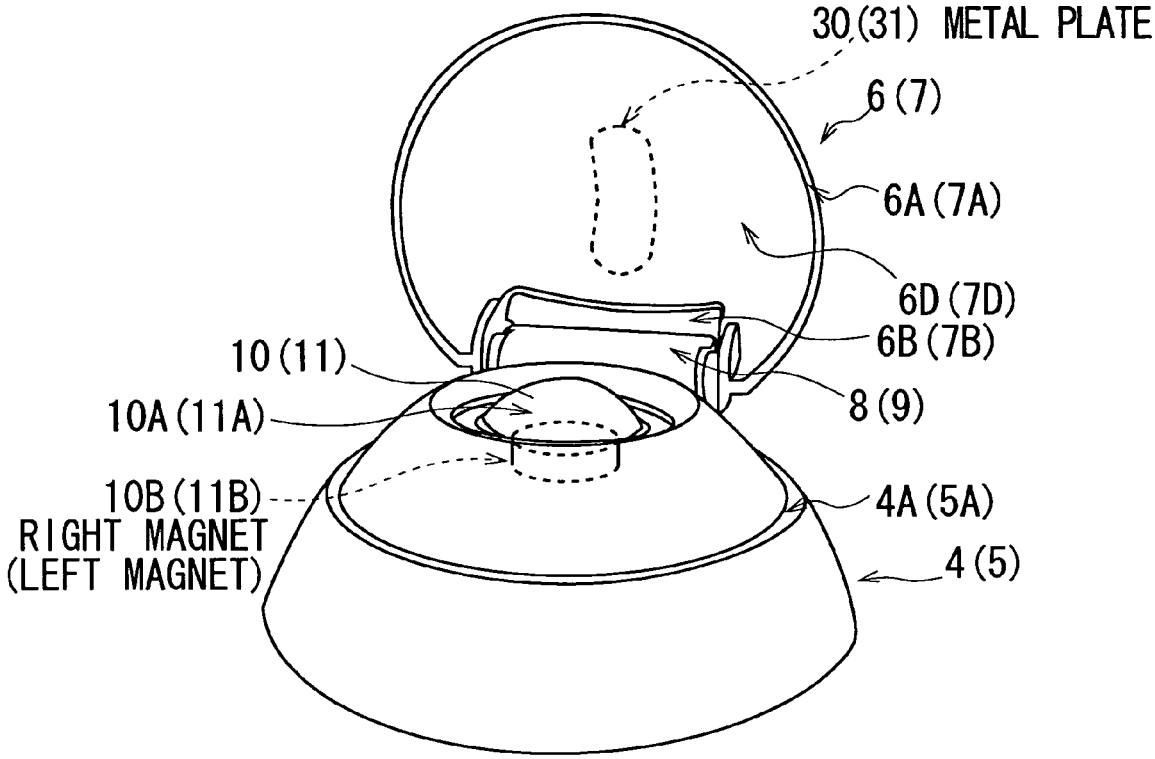
FIG. 8 is a schematic perspective view of a device to illustrate how a metal plate is arranged according to another embodiment of the present invention.
Figure 8B:
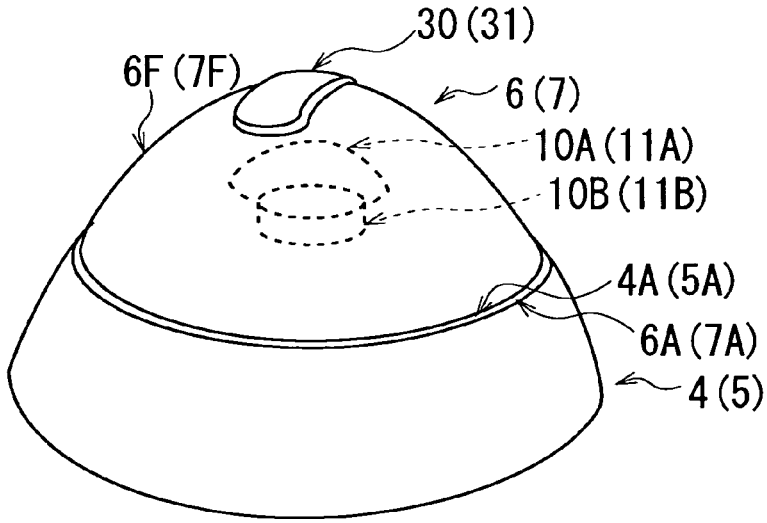
Figure 9A:
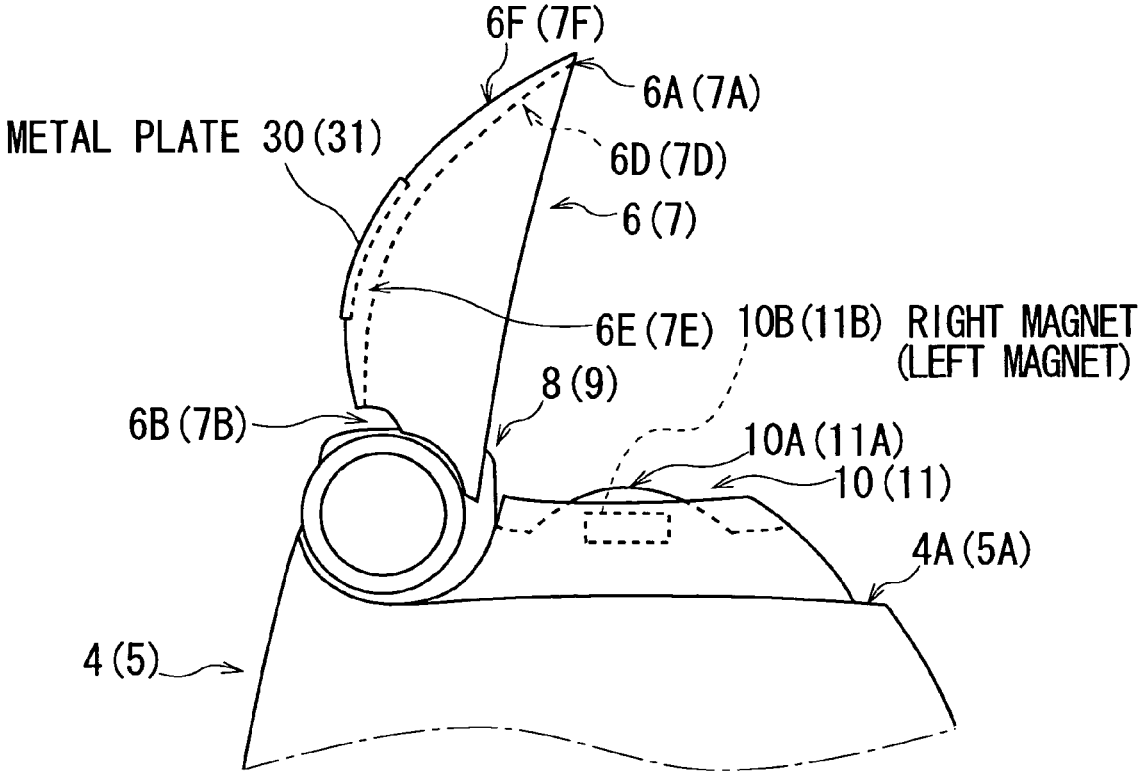
FIG. 9 is a schematic diagram illustrating how a metal plate and a magnet are arranged according to another embodiment of the present invention (1)
Figure 9B:
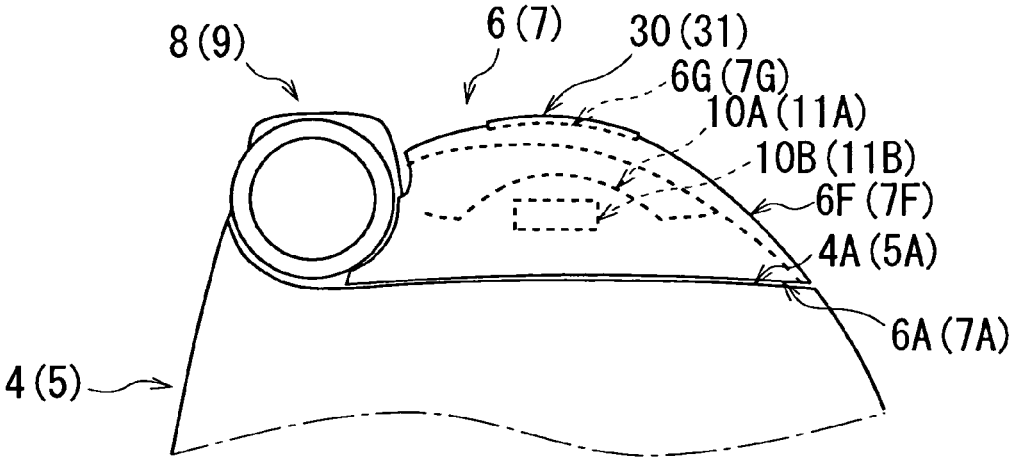
Figure 10A:
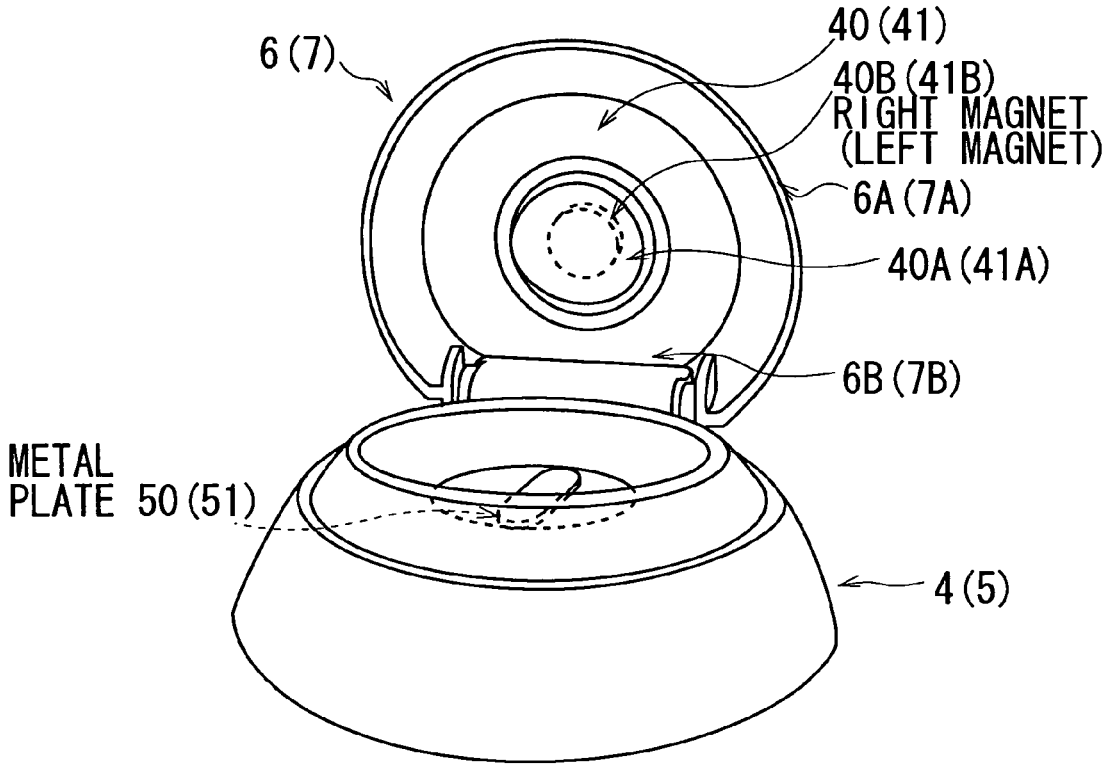
FIG. 10 is a schematic perspective view of a device to illustrate how a right speaker and a left speaker are arranged according to another embodiment of the present invention.
Figure 10B:
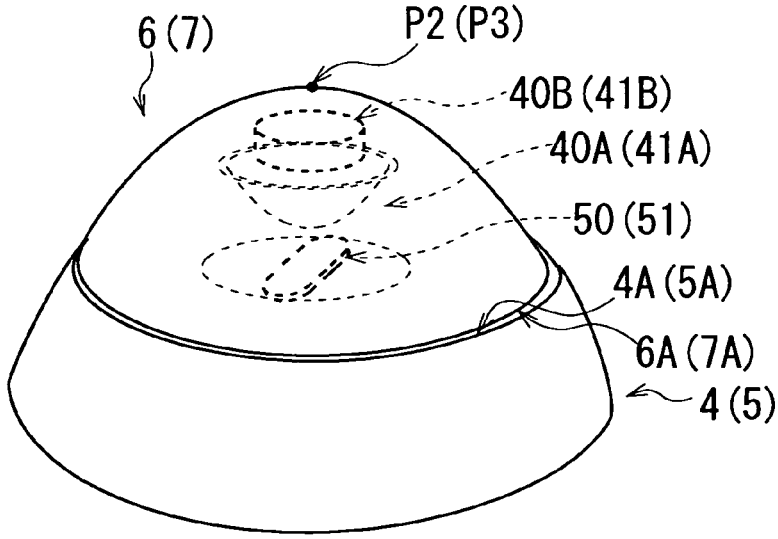
Figure 11A:
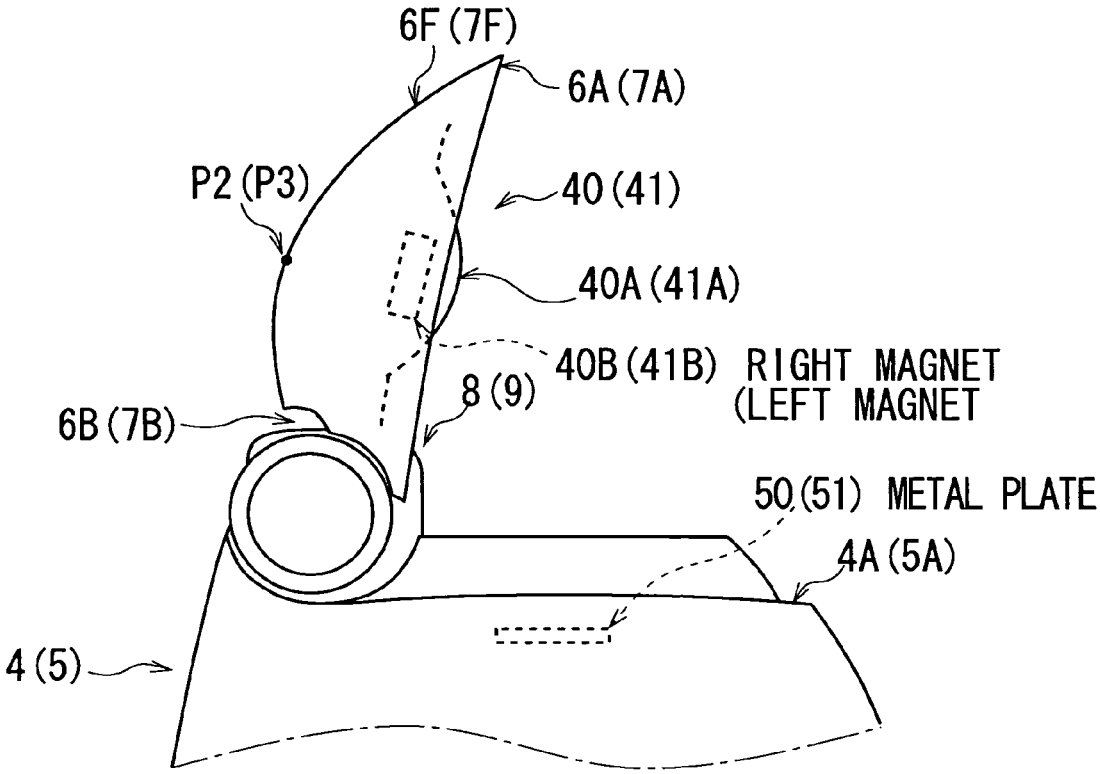
FIG. 11 is a schematic diagram illustrating how a metal plate and a magnet are arranged according to another embodiment of the present invention (2).
Figure 11B:
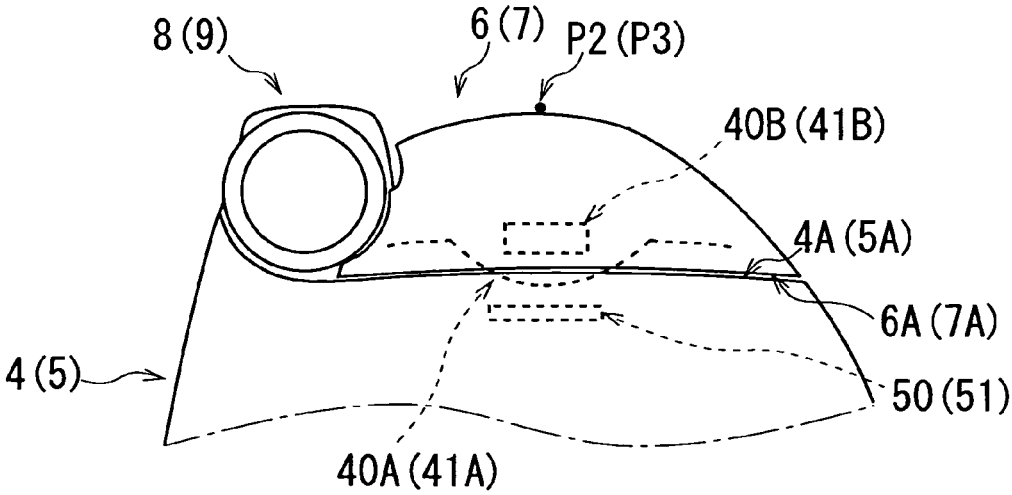

The following describes the circuit configuration of the audio robot device 1. As shown in FIG. 7, the audio robot device 1 includes a control section 100 that takes overall control of the audio robot device 1.

The audio robot device 1 includes a driving section 101 that drives and controls a movable section 102. The audio robot device 1 also includes a driving control section 104 that controls a light emitting section 103.

In this case, the movable section 102 includes the right rotational unit 4, the left rotational unit 5, the right opening-and-closing unit 6, the left opening-and-closing unit 7, the right wheel 12, and the left wheel 13.

The light emitting section 103 includes the right light emitting unit 16, and the left light emitting unit 17.

The driving section 101 includes six motors each of which rotates one of the following components: the right rotational unit 4, the left rotational unit 5, the right opening-and-closing unit 6, the left opening-and-closing unit 7, the right wheel 12, and the left wheel 13.

The driving section 101 also includes six rotational detection sensors, such as rotary encoders, to detect the rotation of the six motors.

The driving control section 104 controls the motors of the driving section 101 based on robot-motion data generated from music data. As a result, the audio robot device 1 moves to the music.

In this manner, by controlling the motors of the driving section 101, the driving control section 104 drives the right rotational unit 4, the left rotational unit 5, the right opening-and-closing unit 6, the left opening-and-closing unit 7, the right wheel 12, and the left wheel 13.

The audio robot device 1 includes an input section 105. The input section 105 includes the touch detection sensor 15 and an acceleration sensor 106. The acceleration sensor 106 is placed inside the central unit 3 to detect acceleration of the rotational ellipsoidal body 2.

When detecting a user's finger put on the sensor 15, the touch detection sensor 15 keeps supplying a touch detection signal to the driving control section 104.

The driving control section 104 receives the touch detection signal from the touch detection sensor 15, and thereby recognizes how the finger is put on the touch detection sensor 15.

That is, the driving control section 104, for example, recognizes a tap or two consecutive taps on the sensor 15, or the finger continuously put on the sensor 15.

The acceleration sensor 106, for example, detects the acceleration of the rotational ellipsoidal body 2 around the clock: the detected acceleration is represented in three directions, or X, Y, and Z axes, which are perpendicular to one another.

The acceleration sensor 106 supplies the detected values of x-, y-, and z-acceleration to the driving control section 104 as an acceleration detection signal.

By the way, the x axis is parallel to or the same as the horizontal rotational shaft line L1 of the rotational ellipsoidal body 2. The x axis is also parallel to the direction of a line connecting the left and right ends of the rotational ellipsoidal body 2.

The z axis is parallel to the direction of a line connecting the upper and lower ends of the rotational ellipsoidal body 2 taking the basic attitude.

The y axis is perpendicular to the horizontal rotational shaft line L1 and the direction of a line connecting the upper and lower ends of the rotational ellipsoidal body 2 taking the basic attitude. In addition, the y axis is parallel to the direction of a line connecting the front and back ends of the rotational ellipsoidal body 2 taking the basic attitude.

The driving control section 104, for example, has previously memorized in an internal memory an x-axis reference acceleration value, a y-axis reference acceleration value, and a z-axis reference acceleration value, which represent an x-axis acceleration, y-axis acceleration, and z-axis acceleration of the rotational ellipsoidal body 2 staying on a horizontal floor.

The x-axis reference acceleration value, the y-axis reference acceleration value, and the z-axis reference acceleration value are also collectively referred to as reference acceleration values.

After receiving the acceleration detection signal from the acceleration sensor 106, the driving control section 104 recognizes the attitude of the rotational ellipsoidal body 2 by comparing the acceleration detection signal and the reference acceleration values.

That is, the driving control section 104, for example, recognizes that the rotational ellipsoidal body 2 stays on the floor, or that the rotational ellipsoidal body 2 is running on the floor, or that the rotational ellipsoidal body 2 in a user's hand is shaken.

After receiving the touch detection signal and the acceleration detection signal from the input section 105, the driving control section 104 makes a determination as to whether a command is input by a user into the audio robot device 1 by analyzing how the finger is put on the sensor 15 and the attitude of the rotational ellipsoidal body 2.

If a command is input into the audio robot device 1, the driving control section 104 also decodes the command.

The driving control section 104 then supplies the decoded command to the control section 100.

By the way, by touching the touch detection sensor 15 and changing the attitude of the rotational ellipsoidal body 2, a user can input various commands into the audio robot device 1: a playback command of music, a selection command of selecting a piece of music, or the like.

The control section 100 receives the commands from the driving control section 104, and controls every component of the audio robot device 1 to perform various processes.

The control section 100 is able to wirelessly communicate with an information processing device (not shown), such as a personal computer, through a wireless communication section 107. In such a case, the control section 100 is controlled by the information processing device.

If the information processing device transmits the compressed and encoded piece of music data and the corresponding robot motion data, the control section 100 receives them through the wireless communication section 107.

The control section 100 then stores the piece of music data and the corresponding robot motion data in the storage section 108 such that they are associated with one another.

In this manner, the control section 100 can store the pieces of music data in the storage section 108 along with the corresponding robot motion data.

When a user inputs a playback command into the audio robot device 1 on the floor, the control section 100 reads out the piece of music data from the storage section 108 and performs a playback process such as decoding. The control section 100 then supplies the piece of music data to an output section 109 including the right and left speakers 10 and 11.

Therefore, the control section 100 can output music from the right and left speakers 10 and 11.

At the same time (during the playback of music), the control section 100 reads out the robot motion data, which corresponds to the piece of music, from the storage section 108, and supplies it to the driving control section 104.

The driving control section 104 controls the driving section 101 based on the robot motion data supplied from the control section 100.

In this manner, the driving control section 104 controls the driving section 101 to drive the right rotational unit 4, the left rotational unit 5, the right opening-and-closing unit 6, the left opening-and-closing unit 7, the right wheel 12, and the left wheel 13.

In addition, the driving control section 104 controls the light emitting section 103, or right and left light emitting units 16 and 17, based on the robot motion data.

In that manner, while outputting music from the output section 109, the control section 100 drives the movable section 102 and the light emitting section 103 in synchronization with the melody of music.

In this manner, the control section 100 makes the audio robot device move as if dancing in synchronization with the music being played.

(3) Operation and Effect

As mentioned above, when the opening-and-closing unit 6 (or 7) is closed with respect to the rotational unit 4 (or 5), the metal plate 20 (or 21) of the opening-and-closing unit 6 (or 7) is attracted toward the magnet 10B (or 11B) thanks to the leak of magnetic flux, thereby pulling the opening-and-closing unit 6 (or 7) toward the rotational unit 4 (or 5). This keeps the opening-and-closing unit 6 (or 7) closed.

Moreover, the size of the metal plate 20 (or 21) and its position with respect to the rotational unit 4 (or 5) is determined so that the metal plate 20 (or 21) can act on the leak of magnetic flux from the magnet 10B (or 11B) within the predetermined opening-and-closing range. This puts little burden on the opening-and-closing mechanical unit 8 (or 9)'s motor that rotates to open and close the opening-and-closing unit 6 (or 7).

According to the above configuration, the opening-and-closing unit 6 (or 7) has the metal plate 20 (or 21) that is, when the opening-and-closing unit 6 (or 7) is closed with respect to the rotational unit 4 (or 5), attracted to the magnet 10B (or 11B) of the speaker 10 (or 11). The metal plate 20 (or 21) helps keep the opening-and-closing unit 6 (or 7) closed. Therefore, the speaker 10 (or 11) is protected.

Moreover, the size of the metal plate 20 (or 21) and its position with respect to the rotational unit 4 (or 5) is determined so that the metal plate 20 (or 21) can act on the leak of magnetic flux from the magnet 10B (or 11B) within the predetermined opening-and-closing range. This puts little burden on the opening-and-closing mechanical unit 8 (or 9)'s motor that rotates to open and close the opening-and-closing unit 6 (or 7). In this manner, the metal plate 20 (or 21) and the magnet 10B (or 11B) put little burden on the motors, and thereby cut down on power consumption.

Furthermore, the size of the metal plate 20 (or 21) is determined so that, when the opening-and-closing unit 6 (or 7) is closed with respect to the rotational unit 4 (or 5), the metal plate 20 (or 21) is positioned a little above the front of the diaphragm 10A (or 11A) of the speaker 10 (or 11). This prevents the metal plate 20 (or 21) from coming in contact with the front of the diaphragm 10A or (11A), thereby avoiding deterioration in the quality of sound output from the speaker 10 (or 11).

Furthermore, only the metal plate 20 (or 21) is added to the audio robot device 1, without being equipped with other magnets, and this simple addition ensures that the opening-and-closing unit 6 (or 7) is appropriately closed.

(4) Other Embodiments

In the above-noted embodiment, the metal plate 20 (or 21) is placed in the concave section 6E (or 7E), which is formed around the center of the inner wall 6D (or 7D) of the opening-and-closing unit 6 (or 7). However, the present invention is not limited to this. For example, as shown in FIGS. 8A, 8B, 9A, and 9B, a metal plate 30 (or 31), which work in the same way as the metal plate 20 (or 21), may be placed in a concave section 6G (or 7G) formed around the center of the outer wall 6F (7F) of the opening-and-closing unit 6 (or 7). This configuration can present the same effect as the above-noted embodiments.

Moreover, instead of providing a metal plate on the opening-and-closing unit 6 (or 7), the opening-and-closing unit 6 (or 7) may be made of metal or a resin containing metal particles, in which case the opening-and-closing unit 6 (or 7) serves as the metal plate.

In such a case, the opening-and-closing unit 6 (or 7) itself acts on the leak of magnetic flux from the speaker 10 (or 11). This configuration can present the same effect as the above-noted embodiments.

Moreover, in the above-noted embodiment, as a metal plate attached to the audio robot device 1, the oval-track-shaped metal plate 20 (or 21) is applied. However, the present invention is not limited to this. As long as they act on the leak of magnetic flux from the magnet 10B (or 11B), the shape of the metal plate 20 (or 21) is not confined to an oval track. The metal plate may be formed in a circular, ellipsoidal, square, square, or rectangular shape. In addition, the combination of them may be used.

Furthermore, in the above-noted embodiment, when the opening-and-closing unit 6 (or 7) is closed with respect to the rotational unit 4 (or 5), the metal plate 20 (or 21) is positioned a little above the front of the diaphragm 10A (or 11A) of the speaker 10 (or 11). However, the present invention is not limited to this. As long as the magnet 10B (or 11B) of the speaker 10 (or 11) can act on the metal plate 20 (or 21) to pull the opening-and-closing unit 6 (or 7) in the closing direction, the metal plate 20 (or 21) may be situated at any other place on the opening-and-closing unit 6 (or 7). In such a case, the metal plate 20 (or 21) may come in contact with the speaker 10 (or 11).

Furthermore, in the above-noted embodiment, as a speaker containing a magnet for vibrating a diaphragm to output sound, the speaker 10 (or 11) having the diaphragm 10A or (11A) and the magnet 10B (or 11B) (FIGS. 1 to 7) is applied.

However, the present invention is not limited to this. As long as it contains a magnet, a different type of speaker can be applied, such as a speaker containing a cone-shaped or horn-shaped diaphragm.

Furthermore, in the above-noted embodiment, as a speaker housing unit housing a speaker with the front of the diaphragm exposed, the rotational unit 4 (or 5) (FIGS. 1 to 7) is applied. However, the present invention is not limited to this. The rotational ellipsoidal body 2 that does not have a rotational unit can be applied.

In such a case, as a housing unit, the opening-and-closing unit 6 (or 7) can be applied.

More specifically, for example, as shown in FIGS. 10A, 10B, 11A and 11B, the opening-and-closing unit 6 (or 7) may house the speaker 40 (or 41).

In this case, the speaker 40 (or 41) is housed in the opening-and-closing unit 6 (or 7) so that the front of its dome-shaped diaphragm 40A (41B) exposed through the inner wall 6D (or 7D) of the opening-and-closing unit 6 (or 7).

On the other hand, a metal plate 50 (or 51), which can be attracted by a magnet, is situated inside a hole section 4C (5C) of the rotational unit 4 (or 5).

When the opening-and-closing unit 6 (or 7) is closed with respect to the rotational unit 4 (or 5), the diaphragm 40A (41B) of the speaker 40 (or 41) is positioned a little above the metal plate 50 (or 51) of the rotational unit 4 (or 5). This configuration can present the same effect as the above-noted embodiments.

Furthermore, in the above-noted embodiment, as an opening-and-closing unit attached to the speaker housing unit so that the opening-and-closing unit can both open, with respect to the speaker housing unit, to expose the front of the diaphragm and close to cover the front of the diaphragm, the opening-and-closing unit 6 (or 7) (FIGS. 1 to 7) is applied. However, the present invention is not limited to this. If the opening-and-closing unit 6 (or 7) serves as a housing unit, the rotational unit 4 (or 5) works as an opening-and-closing unit.

More specifically, for example, as shown in FIGS. 10A, 10B, 11A, and 11B, that configuration can be realized by putting the metal plate 50 (or 51) on the rotational unit 4 (or 5).

Furthermore, in the above-noted embodiment, a metallic component that is attracted to a magnet of a speaker to pull the opening-and-closing unit in a closing direction when the opening-and-closing unit is closed with respect to the speaker housing unit, the metal plate 20 (or 21) (FIGS. 1 to 7) is applied. However, the present invention is not limited to this. The metal plate may be made of other kinds of metal, including ferrite, a ceramic compound consisting of a mixed oxide of iron and one or more other metals. The metal plate may be previously magnetized.

Accordingly, in case the magnet 10B (or 11B) of the speaker 10 (or 11) is not strong enough to pull the opening-and-closing unit 6 (or 7), the magnetized metal plate 20 (or 21) can compensate for the weakness of the magnet 10B (or 11B), and therefore the opening-and-closing unit 6 (or 7) can be pulled.

Furthermore, in the above-noted embodiment, as a speaker unit, the audio robot device 1 (FIGS. 1 to 7) is applied. However, the present invention is not limited to this. Such devices as a desktop audio player having a cover for protecting the front of a speaker or a headphone having a cover for protecting a speaker can be also applied.

Furthermore, in the above-noted embodiment, as an audio output robot device, the audio robot device 1 (FIGS. 1 to 7) is applied. However, the present invention is not limited to this. Such devices as a robot device equipped with two legs and a cover to protect the front of a speaker or a car having a cover for protecting a horn can be also applied.

The above method can be applied to an audio robot device that can output music.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker unit comprising:

a speaker that contains a magnet for vibrating a diaphragm to output sound;

a speaker housing unit that houses the speaker so that a front of the diaphragm is exposed outside;

an opening-and-closing unit that is attached to the speaker housing unit so that the opening-and-closing unit can both open, with respect to the speaker housing unit, to expose the front of the diaphragm outside and close to cover the front of the diaphragm; and a metallic component that is provided on the opening-and-closing unit and is, when the opening-and-closing unit is closed with respect to the speaker housing unit, attracted to the magnet of the speaker to pull the opening-and-closing unit in a closing direction.

2. The speaker unit according to claim 1, wherein the metallic component is situated on the opening-and-closing unit so that, when the opening-and-closing unit is closed with respect to the speaker housing unit, the metallic component is positioned above the front of the diaphragm.

3. The speaker unit according to claim 2, wherein the size, shape, or position of the metallic component is determined so that the metallic component acts on the magnet when the angle of the opening-and-closing unit with respect to the speaker housing unit is within a predetermined opening-and-closing angle range, the opening-and-closing angle range being from a closed angle, at which the opening-and-closing unit is closed with respect to the speaker housing unit, to a predetermined angle, at which the opening-and-closing unit is opened with respect to the speaker housing unit.

4. An audio output robot device comprising:

a speaker that contains a magnet for vibrating a diaphragm to output sound;

a speaker housing unit that houses the speaker so that a front of the diaphragm is exposed outside;

an opening-and-closing unit that is attached to the speaker housing unit so that the opening-and-closing unit can both open, with respect to the speaker housing unit, to expose the front of the diaphragm outside and close to cover the front of the diaphragm;

a driving unit that opens and closes the opening-and-closing unit; and a metallic component that is provided on the opening-and-closing unit and is, when the opening-and-closing unit is closed with respect to the speaker housing unit, attracted to the magnet of the speaker to pull the opening-and-closing unit in a closing direction.

5. The audio output robot device according to claim 4, wherein the metallic component is situated on the opening-and-closing unit so that, when the opening-and-closing unit is closed with respect to the speaker housing unit, the metallic component is positioned above the front of the diaphragm.

6. The audio output robot device according to claim 5, wherein the size, shape, or position of the metallic component is determined so that the metallic component acts on the magnet when the angle of the opening-and-closing unit with respect to the speaker housing unit is within a predetermined opening-and-closing angle range, the opening-and-closing angle range being from a closed angle, at which the opening-and-closing unit is closed with respect to the speaker housing unit, to a predetermined angle, at which the opening-and-closing unit is opened with respect to the speaker housing unit.

* * * * *